US012582883B2

(12) United States Patent
Vega De Seoane Kindelán

(10) Patent No.: US 12,582,883 B2
(45) Date of Patent: Mar. 24, 2026

(54) GOLF FLAG POLE

(71) Applicant: Golf Gurú, S.L., Madrid (ES)

(72) Inventor: Gabriel Vega De Seoane Kindelán, Madrid (ES)

(73) Assignee: Golf Gurú, S.L., Madrid (ES)

( * ) Notice: Subject to any disclaimer, the term of this patent is extended or adjusted under 35 U.S.C. 154(b) by 0 days.

(21) Appl. No.: 17/614,877

(22) PCT Filed: Feb. 11, 2021

(86) PCT No.: PCT/ES2021/070095

§ 371 (c)(1),
(2) Date: Nov. 29, 2021

(87) PCT Pub. No.: WO2021/176118

PCT Pub. Date: Sep. 10, 2021

(65) Prior Publication Data

US 2022/0395732 A1 Dec. 15, 2022

(30) Foreign Application Priority Data

Mar. 2, 2020 (ES) ..... ES202030368 U

(51) Int. Cl.
*A63B 57/30* (2015.01)

(52) U.S. Cl.
CPC ..... *A63B 57/357* (2015.10)

(58) Field of Classification Search
CPC ..... A63B 57/357
USPC ..... 473/176, 177
See application file for complete search history.

(56) References Cited

U.S. PATENT DOCUMENTS 979,313 A * 12/1910 King et al. ..... A63B 57/40 473/177
3,204,599 A * 9/1965 Milosch ..... A63B 57/40 116/63 R
3,240,183 A * 3/1966 Walter ..... A63B 57/40 40/598
3,732,845 A * 5/1973 Istre ..... G09F 17/00 116/173
4,201,975 A * 5/1980 Marcus ..... E01F 9/617 40/607.1
4,601,255 A * 7/1986 Marcotti ..... G09F 17/00 116/28 R
4,891,152 A * 1/1990 Miller ..... C09K 19/544 252/299.5
4,905,624 A * 3/1990 Krolzick ..... G09F 17/00 116/222
5,163,684 A * 11/1992 Seidler ..... A63B 57/40 473/196
5,572,835 A * 11/1996 Atkins ..... G09F 17/00 248/407
6,083,114 A * 7/2000 Bailey ..... A63B 57/357 473/196

(Continued)

*Primary Examiner* — Joseph B Baldori
(74) *Attorney, Agent, or Firm* — Dinsmore & Shohl LLP

(57) ABSTRACT

A golf flag (1) comprising a pole (2) comprising a first upper region with a first extremity to which a flag is attached and wherein a second lower extremity of the pole (2), consisting of a transparent part or section (3) will coincide with the zone of the pole (2) closest to a hole (4) of the Green in its position for use. Thanks to the invention, it is possible to reduce the "slow play effect" in golf by making it unnecessary to remove the flag when executing the putt.

11 Claims, 3 Drawing Sheets

(56) References Cited

U.S. PATENT DOCUMENTS 7,004,104 B1 * 2/2006 Kundus ..... G09F 17/00 116/173
8,187,113 B2 * 5/2012 Lim ..... A63B 57/357 116/173
8,215,807 B1 * 7/2012 Brunesti ..... G09F 17/00 362/800
8,608,167 B2 * 12/2013 Raymond ..... A63B 63/007 116/222
8,740,716 B1 * 6/2014 Mallonee ..... A63B 57/405 473/177
8,998,737 B2 * 4/2015 Reid ..... A63B 69/36 473/150
9,928,764 B2 * 3/2018 Heath ..... G09F 17/00
11,383,140 B2 * 7/2022 Lundin ..... A63B 57/357
2002/0134297 A1 * 9/2002 Moye ..... G09F 17/00 116/173
2002/0159252 A1 * 10/2002 Kasina ..... G09F 17/00 362/186
2004/0083633 A1 * 5/2004 Mueller ..... G09F 17/00 40/591
2004/0185953 A1 * 9/2004 Carilli ..... A63B 63/06 473/174
2005/0272515 A1 * 12/2005 Hurley ..... A63B 57/40 473/173
2007/0035956 A1 * 2/2007 Topps ..... G09F 17/00 362/473
2007/0089338 A1 * 4/2007 Barnhouse ..... G09F 17/00 40/604
2007/0220790 A1 * 9/2007 Wagter ..... G09F 17/00 40/218
2008/0127881 A1 * 6/2008 Stegmann ..... A63B 57/357 116/173
2010/0160057 A1 * 6/2010 Willett ..... A63B 57/357 362/183
2013/0250559 A1 * 9/2013 Hawkins ..... G09F 17/00 362/183
2016/0155369 A1 * 6/2016 Hong ..... G09F 27/007 362/559
2016/0210887 A1 * 7/2016 Carson ..... G09F 17/00
2016/0320050 A1 * 11/2016 Barnhart ..... F21L 4/08
2018/0353819 A1 * 12/2018 Debono ..... B32B 27/12
2022/0214603 A1 * 7/2022 Aonuma ..... H04N 23/51
2024/0009530 A1 * 1/2024 Park ..... A63B 57/00

* cited by examiner

GOLF FLAG POLE

CROSS-REFERENCE TO RELATED APPLICATIONS

This application is a U.S. National Phase of PCT/ES2021/070095, entitled "GOLF FLAG POLE" and filed Feb. 11, 2021, which claims priority to Spanish Application No. ES202030368U entitled "MASTIL DE BANDERA DE GOLF", filed Mar. 2, 2020, each of which is incorporated herein by reference in its respective entirety.

TECHNICAL FIELD OF THE INVENTION

The present invention relates to a golf flag pole that indicates the location of the hole into which the ball must enter in the fewest possible number of strokes. More specifically, the present invention relates to a flag pole that helps to improve the so-called "slow play problem" in said sport.

STATE OF THE ART

In golf, since its invention around the fifteenth century, a flag has been used, with its corresponding pole, to indicate the position of the hole into which the ball must enter in the fewest number of strokes possible. The United States Golf Association (USGA), and the Royal & Ancient (R&A), located in the Scottish town of St. Andrews, are the two organizations that run golf globally and are responsible for implementing the rules of the game. Every so often, both organizations, in a coordinated manner, propose modifications to these rules to adapt golf to the corresponding requirements.

The hole and flag are always in the area called the Green, which R&A and USGA rules simply define as "the area that is especially prepared for putting." Putting is the action of striking with a club called a "putt" which, precisely due to the smoothness of the surface of the Green, allows the ball to roll with the appropriate precision to enter the hole.

The pole of a golf flag is designed in such a way that it can be inserted and removed from the golf hole with ease. The reason for this characteristic is that, historically, the rule required that, when the golf ball was lying on the Green, the flag should be removed and, therefore, the putting action was necessarily carried out with no flag in the hole. Conversely, when the ball is not lying on the Green, the player can choose between maintaining or removing the flag. That is, a ball that rolled onto the Green and entered the hole with the flag in place would not be penalized if the stroke had been made from outside the Green.

The above rule has always generated some controversy. Thus, the reason for the rule can be understood to be that putting with the flag in place represented a certain advantage for very fast putts, which, without the help of the pole, would never have entered the hole. On the other hand, other opinions have been contrary to this explanation, as they consider that the hole is less visible with the flag than without it.

A peculiarity of the aforementioned rule is that, although it is true that it was not acceptable for the ball to enter the hole with the flag in place, it was acceptable, however, with it in place at the time when the player made the putt, provided that there was someone (the caddy or another player) in charge of the flag to remove it immediately after the stroke by the player, so that the ball would never meet the pole in the hole and, therefore, the rule would not be broken, which would imply a penalty of two strokes. Normally, it is the player who requests that the flag be attended to when his ball is located at a long distance from the hole, so he cannot see the hole well if the pole that acts as a visual reference is not in place.

Also pertinent is the fact that of all the players who make up the corresponding match (up to a maximum of four) it is the golf player furthest away from the hole who is responsible for making the next stroke. The case may arise that there is a player whose ball is outside the Green, but even so, it is closer to the hole than that of another player whose ball is lying on the Green. Therefore, this last player should play first, and historically, he could choose between having the flag attended to or, directly, request that it be removed in order to comply with the rule. When it was the turn of the player who was outside the Green, if he chose to play with the flag in place, it had to be placed back in the hole. Subsequently, once all the players were on the Green, the flag had to be removed once more to comply with the rule, that is, to putt without a flag.

This method of playing consumes a lot of time, among other situations, because of the obligation to remove the flag for balls lying on the Green, because of the option of the player requesting that the flag be attended to, and the obligation for someone to subsequently remove it and, due to the situation described in the preceding paragraph, in which first of all the flag had to be removed for the players who were on the Green, and subsequently replaced because there were players outside the same who were closer to the hole.

Golf is probably the sport with the longest playing time; at an amateur level it is on average about five hours, and at a professional level about four and a half hours. This fact is influenced by many of the characteristics inherent to the game: the size of the playing field is immense; it is played on courses (of eighteen holes) the total length of which ranges between five and seven kilometers; it is played walking and not running; the concentration required to execute the mechanics learned to produce each type of ball trajectory; the large amount of decision-making that takes place in a stroke, such as the choice of the club according to the distance and the wind, the choice of path of the ball, the risk the player wishes to take, among others; the excessive time spent in the search for balls in areas of tall grass or brush, this occurring more at an amateur level than at a professional one, where the maximum search times are tightly controlled, and the maximum search time rule is applied strictly. Finally, the slowness of the game is also influenced by the aforementioned problem of the time lost in the application of the rules relating to placing and removing the flag, with all the aforementioned specific cases of attending to it, replacing it for the players who were closer but outside the Green.

Additionally, it should be noted that, both in amateur competitions and in professional competitions, the number of players taking part is over a hundred, which implies that the first to go out to play do so first thing in the morning and the last finish their game just before nightfall. That is, a day of golf at a club can last over twelve hours until all the rounds of all the competing players are completed.

Therefore, as a result of the above, slow play has always been considered a major problem (https://golfdigest.com.ar/no-momento-golf-profesional-solucione-problema-juego-lento/). For example, in January 2020, European Golf Circuit officials, in order to combat slow play, imposed economic sanctions and stroke penalties on those particularly slow players who either lose a hole with regard to the aforegoing game due to slow progress, or take an excessive amount of time until the stroke is executed (https://www.golfchannel.com/news/european-tour-gets-tougher-slow-play-display-abu-dhabi). However, it should be noted that all these attempts to solve slow play are achieved by focusing on psychological/cognitive aspects (such as concentration or decision-making) and physiological aspects (walking pace) of the player, and that is why it has always partially or totally failed, at both professional and amateur levels, when there has been an attempt to solve the slow play problem by focusing on these aspects that are so sensitive for the player.

It is no coincidence, therefore, that many of the new golf rules proposed by the R&A and the USGA and which came into effect in early 2019, have attempted to address the problem of slow play (https://golfdigest.com.ar/no-momento-golf-profesional-solucione-problema-juego-lento/). One of the proposed changes affected the time allowed to search for a ball, which was reduced from five to three minutes; another of these changes, and especially pertinent to this invention, is the new Rule 13.2a (2), which says, whether the ball is played from the Green or from outside it, that: "there is no penalty if the ball hits the flagpole left in the hole: if the player makes a stroke with the flagpole left in the hole and the moving ball hits the flagpole: (i) there is no penalty (except as provided for in rule 13.2a (1)); the ball must be played as it lies"

Let us see the implications that this modification has in the event that none of the players of the game wish to remove the flag: it is not necessary to remove it for players whose balls lie on the Green and are also farther away than those of others whose balls are not lying on the Green, for whom the flag must be replaced; the flag need not necessarily be attended to for those who cannot see the hole well due to its being a considerable distance away. In short, it may be seen that the time savings that this new rule can entail are enormous.

It was thought that the new rule regarding the possibility of playing with a flag in place when the ball is lying on the Green would be a great solution to slow play, because a priori it was thought that it did not affect physiological aspects, as do the other proposals described above, because it does not imply a greater physical requirement, as does, for example, increasing the walking pace; or psychological or cognitive aspects, because not removing the flag should not affect concentration, decision-making, or the mechanical execution of the putting movement in this case.

However, the new rule has not been well received by some players, as can be read in the following article (https://www.golfdigest.com/story/the-science-behind-why-the-flagstick-should-be-pulled-999-percent-of-the-time) because: (a) in short putts they see the flag as visually intimidating and this is felt as a distraction; (b) they feel that the hole looks smaller with the flag in place—in short putts—and find this puzzling; (c) they feel that with the flag there is a sense of a "buffer", particularly for long downhill putts, where there could be an increase in speed; and (d) they dislike the sight/notion of something that is "radically different" from what they have always been used to, as they state that they are internally distracted from the relevant signals that have worked in their pre-putt routine or during putt execution. Other players, on the other hand, are supportive of the new rule and have talked about the feeling of having a greater awareness of the hole for short to mid-range putts, as they can see the flag in their peripheral vision when they are in the right position prior to the stroke (https://www.golfdigest.com/story/the-science-behind-why-the-flagstick-should-be-pulled-999-percent-of-the-time).

In short, the problem of slow play is a serious issue in golf that has historically required a technical solution. In general, various solutions are described in the state of the art that attempt to solve said problem with generally complicated electronic means that require—logically—the implementation of an electrical power supply infrastructure, wiring or a multitude of wireless devices. Among these solutions the following patents may be highlighted: U.S. Pat. Nos. 5,438,319, 8,460,111 or WO2018/192863, all of which are descriptive of the problem of slow play in golf.

On the other hand, golf flag poles are also known which include screens for displaying advertisements (see, for example, documents US2008/127881 or WO2007/132218), and even internally-lit golf flag poles for night use (U.S. Pat. No. 6,699,137). However, none of these poles would enable the solution of the slow play issue in golf. On the contrary, they include in-game distractions that could make it even slower.

EXPLANATION OF THE INVENTION

The object of the present invention is to provide a tool that facilitates the application of the new rule of the game of golf, whose purpose is to overcome the problem known as "slow play", since it allows the flag not to be removed in situations in which it was mandatory to do so and in which game time was lost. Thus, the object of the present invention is not focused on the flag itself, i.e. the fabric that crowns the pole, the function of which is as an indicator of the direction of the wind, so as to help the player in choosing the path of the ball, but on the pole that bears said flag. This object is achieved with the pole described herein. Particular embodiments of the invention are described in dependent claims.

Thanks to the pole of claim 1, it is possible to solve the need described in the state of the art that favors the application of the new rule 13.2a (2), which allows the golf flag to remain in place when the ball lies on the Green, thus to combat slow play, now undoubtedly one of the greatest problems of the game. The challenge is greater if one takes into account the division of opinions regarding the application of the rule, with some players in favor and others against it. It should be noted that the new rule allows the flag not to be removed, and thus invites the players not to do so, to try to speed up the game, but it does not make the non-removal thereof obligatory either. The aim of the proposed invention is to ensure that a single golf flag design, in particular its pole, satisfies the regulations without generating controversies between players.

For the group of players who do not apply the possibility of leaving the flag in place when their ball lies on the Green, due most likely to any one of the reasons listed in the state of the art and which concern, in general, the visual perception of the flag (i.e. the flag is visually intimidating, the hole appears to be smaller) or psychological reasons (i.e. the flag gives a sense of a "buffer"). However, the present invention proposes a pole that, at its extremity closest to the hole, is of a transparent material, in such a way that the entirety of the hole is visible through said transparent part of the pole, in practice granting a sensation very similar to that of playing without the flag in place, with the advantage that, in this way, its removal and re-positioning would not be necessary, solving the problem of slow play.

For the group of players who apply the new rule 13.2a (2) and therefore no longer remove the flag when their ball lies on the Green, as seeing the flag provides a greater awareness of the location of the hole for short- or mid-range putts, the invention proposes means to cancel the effect of transparency. These means can be in two forms: a simple outer cover for the pole that can be deployed and furled at will, or an electronic device that could make the transparent part of this invention appear opaque by means of an electric current.

Throughout the description and claims, the word "comprises" and its variants are not intended to exclude other technical features, additives, components or steps. For those skilled in the art, other objects, advantages and features of the invention will emerge, in part from the invention and in part from the putting into practice of the invention. The following examples and drawings are provided by way of illustration and are not intended to restrict the present invention. In addition, the invention covers all possible combinations of particular and preferred embodiments indicated herein.

BRIEF DESCRIPTION OF THE DRAWINGS

A very brief description of a series of drawings provided for the better understanding of the invention, and relating expressly to an embodiment of said invention, illustrated as a non-limiting example thereof, appears below.

PREFERRED EMBODIMENT OF THE INVENTION

Figure 1:
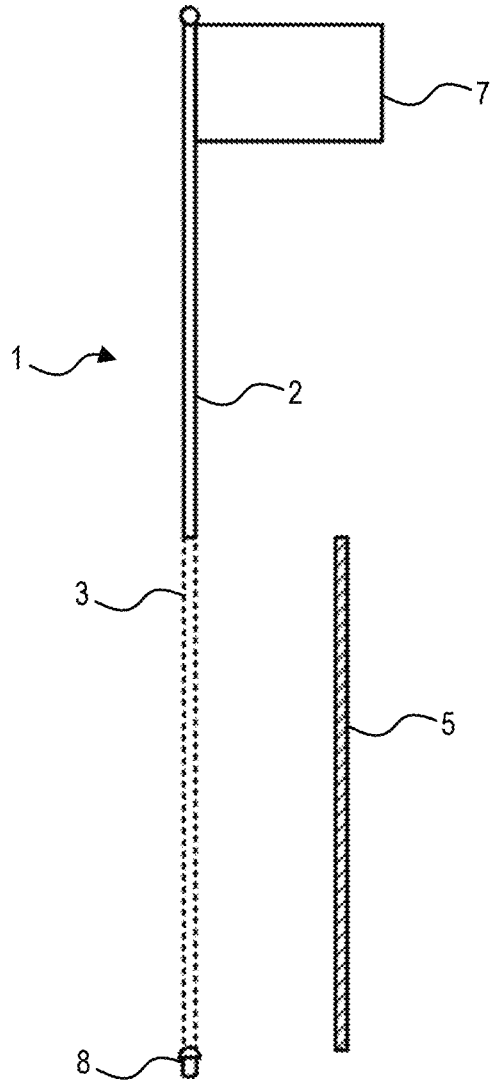
FIG. 1 schematically portrays a golf flag in accordance with the present invention, having a pole the bottom of which (closest to the hole) is transparent, and wherein a cover is also portrayed whose purpose is to cover the bottom part of the pole for this to cease to be transparent.
Figure 2:
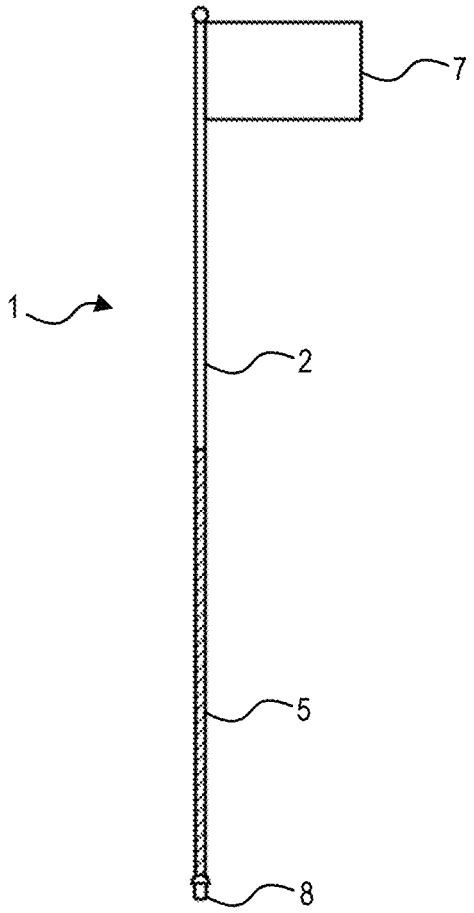
FIG. 2 schematically portrays a golf flag in accordance with the present invention, the pole of which is transparent at the bottom, and which in this case is covered by a cover which cancels this characteristic.
Figure 3:
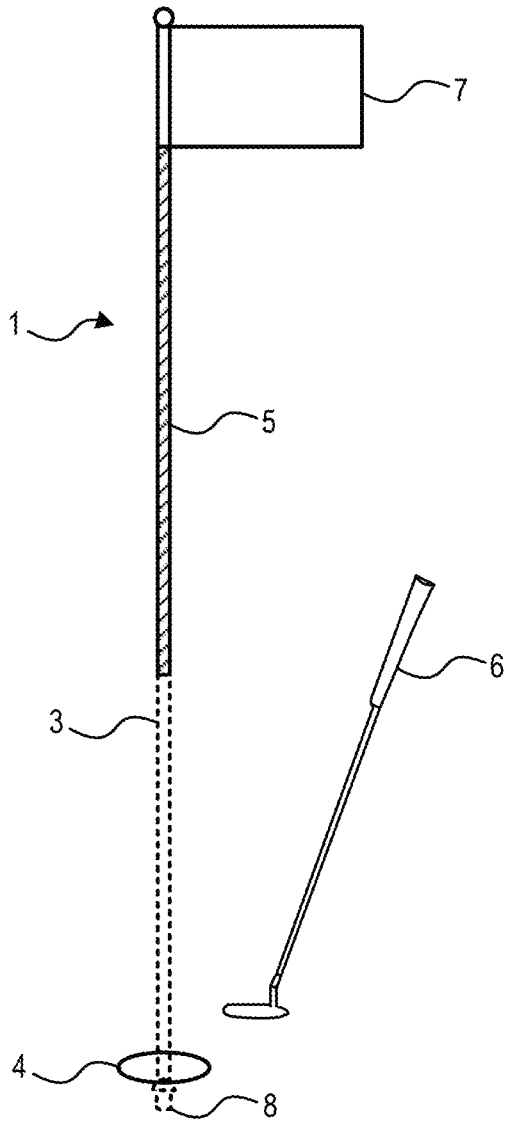
FIG. 3 portrays a drawing of a golf flag in accordance with the present invention, the pole whereof is transparent at the bottom, as the cover that covers it has been raised. A putt is also portrayed, which is the club that is used when the ball lies on the Green.

Golf flags are 2.30 meters in height, and are currently totally opaque. However, as may be seen in FIG. 1, the present disclosure relates to a flagpole 1 (which may also be referenced as a "golf flag") having an elongate pole that includes a first end 2, a second end 3 (which may also be referenced as a "bottom part" or "bottom section"). The first end 2 may be opaque (as depicted in FIGS. 1-2), may be coupled to a flag 7, and the second end 3 may be coupled to a ferrule 8 that is configured to be received in a hole 4, as depicted in FIG. 3 (ferrule 8 is shown in phantom in FIG. 3 as being below the surface of the ground of a golf green). Referring collectively to FIGS. 1-3, the second end 3 of the flagpole 1 is transparent (e.g., formed of a transparent material), so that the part closest to the hole 4 is transparent. As indicated, the purpose of this transparency is to generate in the player the sensation that the flag has been removed and that, therefore, no visual or psychological perceptions arise to cause them to request withdrawal, and not to fulfill the aim of rule 13.2a (2) in order to combat slow play. Also depicted in FIG. 1 is a cover 5 that is not attached to the flagpole 1 or in a deployed position, as described in further detail herein.

FIG. 2 shows the flagpole 1 with the cover 5 in the deployed position, canceling the transparency of the bottom part or section (e.g., the second end 3) of the flagpole 1. Thus, in the cases that may require this, the flagpole 1 will be completely opaque. The purpose of providing the invention with this possibility is that the players themselves can choose how they want to play (flag or no flag effect). As already discussed throughout the invention, there may be several reasons for players to prefer to play with the flagpole 1 in an opaque state. Among these reasons, an opaque flagpole 1 can provide increased hole awareness for short- to medium-range putts.

Finally, FIG. 3 portrays the flagpole 1 with the cover 5 in a retracted position so that the transparent second end 3 of the flagpole 1 is visible when the ferrule 8 is inserted into the hole 4 (as indicated in phantom), so that the visual sensation of the flagpole 1 is that it has been removed from the hole 4. Also depicted in FIG. 3 is a putter 6, which is the club used when the ball lies on the Green, and with this, it is possible to portray the aforementioned sensation of putting without a flag noted by the player.

In the embodiment indicated in FIGS. 1 to 3, the transparent material of the bottom part (e.g., the second end 3) of the flagpole 1 is a transparent material with a mechanical resistance suitable to withstand the moments of force generated by the wind, as well as to withstand the blows that it may suffer during the course of the game (i.e. being struck by a ball). A suitable material could be a glass with sufficient strength. Another suitable material for manufacturing the transparent second end 3 of the flagpole 1 is an electronically obscuring device. The electronically obscuring device has the advantage that it does not require the use of the cover 5, since by activating or deactivating the transparency of the glass, the flagpole 1 would contain the second end 3 that could become totally opaque, or totally transparent, depending on the wishes of the player and even performing that change at a distance, by activating an electronic circuit that would apply an electric current to the electronically obscuring device. However, this would involve an increase in the cost of the flagpole 1, as well as the provision of additional circuitry to the flagpole 1 and an independent power supply.

In any case, the advantages lie in the field of visual perceptions and the psychology of the player when putting. Therefore, thanks to the present invention, in short putts the player will not see the flag as visually intimidating and will not consider it a distraction. In addition, players will not feel that the hole is smaller with the flag in place, mainly in short putts. The player will not have the perception that the flag acts as a "buffer", particularly in long downhill putts where there could be an increase in speed. Finally, by not perceiving the flagpole 1 the player will not have the sensation of something that is "so radically different" from what they have always been accustomed to, and will not be internally distracted from the pertinent signals that have worked in their pre-putt routine or during the execution of the putt.

In short, on the one hand, this invention causes more players to apply the new golf rule 13.2a (2), which allows the flag to be left in place when the ball lies on the Green, with the consequent contribution to solving the problem of slow play in golf. On the other hand, for those players who already apply this new rule, because they like the feeling of seeing the flag, this invention proposes means (i.e. the cover 5 or the electronically obscuring device) to cancel the transparent second end 3 which, when simply lowered, will provoke that sensation once more. While the cover (5) is an added value for this invention, since as we have seen, it enables the satisfaction of a player who does not want to have the sensation of putting without a flag, it should be considered optional and not necessary; that is, a flag with a transparent extremity, but without a cover, would also be covered by the invention.

The invention claimed is:

1. A golf flag, comprising:

an elongate pole comprising:

a first end coupled to a flag, at least a portion of the first end formed of an opaque material, and a second end opposite the first end, at least a portion of the second end formed of a transparent material; and an elongate cover disposed around the pole, the elongate cover formed of an opaque material and slidably movable between a deployed position and a retracted position, wherein, when the elongate cover is in the deployed position, the elongate cover surrounds an entirety of the transparent material of the second end.

2. The golf flag of claim 1, wherein, when the elongate cover is in the retracted position, the transparent material of the second end is exposed.

3. The golf flag of claim 1, wherein the transparent material of the second end is glass.

4. The golf flag of claim 1, wherein the elongate pole is 2.3 meters long.

5. An apparatus, comprising:

a pole comprising an elongate body having:

a first end coupled to a flag, at least a portion of the first end formed of an opaque material, and a second end opposite the first end, at least a portion of the second end formed of glass that electrically transitions between a transparent state and an opaque state; and an electronically obscuring device electrically coupled to the glass to cause the glass to electrically transition between the transparent state and the opaque state.

6. The apparatus of claim 5, wherein the electronically obscuring device comprises an electronic circuit electrically coupled to the glass that is configured to carry an electric current that causes the glass to transition between the transparent state and the opaque state.

7. The apparatus of claim 6, further comprising a power source electrically coupled to the electronic circuit, the power source configured to provide the electric current to the electronic circuit.

8. The apparatus of claim 5, wherein the pole is 2.3 meters long.

9. A golf flag, comprising:

an elongate pole comprising:

a first end formed of an opaque material, and a second end opposite the first end, the second formed of a visibly transparent material;

a flag coupled to the first end of the elongate pole; and a ferrule coupled to the second end of the elongate pole, the ferrule configured to be received within a hole formed in a ground surface of a golf green, wherein the visibly transparent material of the second end of the elongate pole allows for visualization of an entirety of the hole when the ferrule is inserted into the hole.

10. The golf flag of claim 9, wherein the visibly transparent material of the second end is glass.

11. The golf flag of claim 9, wherein the elongate pole is 2.3 meters long.

* * * * *